United States Patent [19]

Hansmann et al.

[11] Patent Number: 4,928,599

[45] Date of Patent: May 29, 1990

[54] CONTINUOUSLY ADVANCING TRACK LEVELING, LINING AND TAMPING MACHINE

[75] Inventors: Johann Hansmann, Klosterneuburg, Austria; Jörg Ganz, Etoy, Switzerland

[73] Assignee: Franz Plasser Bahnbaumaschinen-Industriegesellschaft m.b.H., Vienna, Austria

[21] Appl. No.: 323,431

[22] Filed: Mar. 14, 1989

[30] Foreign Application Priority Data

Jul. 26, 1988 [EP] European Pat. Off. ..... 88890196

[51] Int. Cl.[5] ..... E01B 27/17

[52] U.S. Cl. ..... 104/12; 104/7.2

[58] Field of Search ..... 104/12, 7.2, 7.3, 7.1, 104/2

[56] References Cited

U.S. PATENT DOCUMENTS

| | | | |
|---|---|---|---|
| 4,103,622 | 8/1978 | Theurer | 104/12 |
| 4,165,694 | 8/1979 | Theurer | 104/12 |
| 4,534,295 | 8/1985 | Theurer | 104/7.2 |
| 4,596,193 | 6/1986 | Theurer | 104/7.2 |
| 4,627,358 | 12/1986 | Theurer | 104/7.2 |
| 4,632,037 | 12/1986 | Theurer et al. | 104/7.2 |
| 4,643,101 | 2/1987 | Theurer | 104/7.2 |
| 4,644,868 | 2/1987 | Theurer et al. | 104/12 |
| 4,646,645 | 3/1987 | Theurer | 104/7.2 |

FOREIGN PATENT DOCUMENTS

| | | | |
|---|---|---|---|
| 648621 | 3/1985 | Switzerland . | |
| 2151675 | 7/1985 | United Kingdom | 104/12 |

*Primary Examiner*—Andres Kashnikow
*Assistant Examiner*—Mark T. Le
*Attorney, Agent, or Firm*—Kurt Kelman

[57] ABSTRACT

A continuously advancing machine for track leveling, lining and tamping comprises a main frame, a single undercarriage supporting the main frame and the main frame having a portion projecting in the track direction from the single undercarriage, a drive connected to the single undercarriage for continuously advancing the main frame in an operating direction, a brake connected to the single undercarriage for stopping the advancing main frame, and an operator's cab, a control arrangement and a power plant mounted on the continuously advancing main frame. The machine further comprises a tool-carrying frame, an undercarriage supporting the tool-carrying frame on the track, the tool-carrying frame supporting undercarriage being widely spaced from the main frame supporting undercarriage and the projecting main frame portion being longitudinally displaceably supported on the tool-carrying frame, a drive for intermittently advancing the tool-carrying frame, tie tamping and track position correcting tools mounted on the tool-carrying frame within sight of the operator's cab, the tools including drives for operating the tools and the drives being actuated by the control arrangement, and a track position reference system connected to the control arrangement for actuating the drives of the track position correcting tools in response to the track position detected by the reference system.

13 Claims, 2 Drawing Sheets

CONTINUOUSLY ADVANCING TRACK LEVELING, LINING AND TAMPING MACHINE

BACKGROUND OF THE INVENTION (1) Field of the Invention

The present invention relates to a continuously advancing machine for leveling, lining and tamping a railroad track, which comprises a main frame extending longitudinally in the direction of the track and a tool-carrying frame longitudinally displaceably connected with the main frame. At least one respective undercarriage supports the main frame and the tool-carrying frame, the tool-carrying frame supporting undercarriage being spaced from the main frame supporting undercarriage a sufficient distance to permit free displacement of the track during leveling and lining. Drive means is connected to the main frame supporting undercarriage for continuously advancing the main frame in an operating direction and a brake is connected to the main frame supporting undercarriage for stopping the advancing main frame. An operator's cab, a control arrangement and a power plant are mounted on the continuously advancing main frame, and a drive means intermittently advances the tool-carrying frame on which there are mounted track leveling and lining and tie tamping tool means within sight of the operator's cab, the tool means including drives for operating the tool means and the drives being actuated by the control arrangement. A track position reference system is connected to the control arrangement for actuating the drives of the track leveling and lining tools in response to the track position detected by the reference system.

(2) Description of the Prior Art

U.S. Pat. Ser. No. 4,627,358, dated Dec. 9, 1986, discloses such a continuously advancing track leveling, lining and tamping machine which has had outstanding commercial success. This machine comprises an elongated, bridge-like main frame supported by widely spaced undercarriages, one of which has a drive and brake means for continuously advancing and stopping the main frame, the main frame carrying a control arrangement and power plant, and a tool-carrying frame arranged between the undercarriages. One end of the tool-carrying frame is supported on the track by a pair of guide wheels constituting an undercarriage for the tool-carrying frame and an opposite tool-carrying frame end is universally joined to the main frame, track leveling and lining tool and tie tamping tool means being mounted on the tool-carrying frame, and the tool-carrying frame and the tool means supported thereon constituting an operating unit longitudinally displaceable relative to the main frame. A hydraulically operated cylinder-piston drive intermittently advances the operating unit. For controlling the leveling and lining operations and assuring an accurate track position correction, a track position reference system is associated with the control arrangement. Since the rear end of the tool-carrying frame is supported on the track by the guide wheels immediately adjacent the tie tamping tool means, a considerable portion of the weight and operating forces of the tool means is transmitted to the track during advancement of the machine. Therefore, the main frame, which advances continuously while the tool-carrying frame advances intermittently, is subjected to a minimum of static and dynamic forces. If a cab for an operator of the tool means is arranged on the main frame, the operator's working conditions will be much improved since he will not be subjected to the impacts and vibrations of the tool means during their operation. This structure for the first time provided a practical tie tamping technology in which the cyclic tie tamping operation is effected on a continuously advancing machine.

U.S. Pat. Ser. No. 4,632,037, dated Dec. 30, 1986, discloses a further development of this continuously advancing track leveling, lining and tamping machine, in which the undercarriage supporting the tool-carrying frame has its own drive and brake means for intermittently advancing the tool-carrying frame. In some embodiments, the tool-carrying frame is supported by two widely spaced undercarriages to form a satellite carriage. The track leveling and lining tool and tamping tool means precede, and are within sight of, an operator's cab mounted on the main frame. Furthermore, a hydraulically operated cylinder-piston drive for stop-and-go advancement of the tool-carrying frame links the tool-carrying frame to the main frame, and this drive may be operated to block relative movement between the frames so that they will advance in unison. This machine, too, has been used very successfully, the independent drive and brake arrangement for the tool-carrying frame assuring an improved and trouble-free relative displacement between the frames during operation of the machine.

U.S. Pat. Ser. No. 4,643,101, dated Feb. 17, 1987, also discloses a further development of such a continuously advancing track leveling, lining and tamping machine, in which the main frame and the tool-carrying frames are linked to each other and each is supported on two undercarriages. A hydraulically operated cylinder-piston drive is arranged to displace the tool-carrying frame longitudinally relative to the main frame to enable the tool-carrying frame to advance intermittently while the main frame advances continuously. A vertically adjustable track stabilizer including vibrating means and means for laterally pivoting the track stabilizing tools is mounted on the main frame between the undercarriages thereof and this track stabilizer is equipped with its own track leveling reference system. As is known, such track stabilizers anticipate the settling of the tamped track under the loads of passing trains and also enhance the resistance to transverse movements of the ties by firmly embedding the ties in the settled ballast to keep the track accurately lined.

Swiss patent No. 648,621, granted Mar. 29, 1985, discloses an intermittently advancing tie tamping machine comprising a frame whose two ends are supported by undercarriages. Track leveling and lining tool and tie tamping tool means are mounted on the machine frame between the two undercarriages. Respective driver's cabs are arranged at the front and rear ends of the machine frame, the front cab serving also as an operator's cab and being longitudinally displaceable on the machine frame by a hydraulical cylinder. During operation, the machine advances intermittently from tie to tie and, while the machine stands still during each tie tamping cycle, the operator's cab continues to advance. When the machine advances again to the next tie to be tamped, the operator's cab is displaced relative to the machine frame in a direction opposite to that of the machine advance, the displacement path being measured by a vertically adjustable odometer. The purpose of this structure is to assure a steady and continuous forward movement for the operator during the intermittent tamping operation. However, the entire heavy machine, except for the relatively light cab, still advances intermittently, which requires the considerable driving and braking forces involved in this intermittent movement wherefore the total efficiency of this tie tamper is no greater than that of the conventional, intermittently advancing tampers in which the operator's cab moves in unison with the machine frame. Nor does it have any particular advantage to make the operator's cab freely transversely displaceable and to guide it on flanged wheels, one of which is driven, along the track rails since the entire power train still operates to advance the machine intermittently. Therefore, this type of tie tamper has found no commercial acceptance.

Finally, U.S. Pat. Ser. No. 4,165,694, dated Aug. 28, 1979, discloses an intermittently advancing track leveling, lining and tamping machine comprising a main frame supported by two undercarriages at respective ends thereof. Track leveling and lining tool and tie tamping tool means are vertically adjustably mounted on the main frame between the undercarriages. An auxiliary frame precedes the main frame in an operating direction and a rear end thereof is coupled to the front end of the main frame by a hydraulic drive for longitudinally displacing the auxiliary frame relative to the main frame while the front end of the auxiliary frame is supported on the track by an undercarriage. A ballast plow is vertically adjustably mounted on the auxiliary frame between the front undercarriage and the longitudinal displacement drive for the auxiliary frame. While the main frame advances intermittently during the tamping operation and stands still each time a tie is tamped, the hydraulic drive displaces the auxiliary frame relative to the main frame so that the ballast plow advances continuously. This arrangement provides more uniform ballasting and, therefore, improves the tie tamping quality but the efficiency of such a machine is no greater than that of the conventional, intermittently advancing track leveling, lining and tamping machine.

SUMMARY OF THE INVENTION

It is the primary object of this invention to provide a continuously advancing machine for leveling, lining and tamping a railroad track, which has a relatively simple structure but considerably enhanced efficiency in comparison to intermittently advancing track leveling, lining and tamping machines.

The above and other objects are accomplished according to the invention with a machine comprising a main frame extending longitudinally in the direction of the track, a single undercarriage supporting the main frame and the main frame having a portion projecting in this direction from the single undercarriage. A drive means is connected to the single undercarriage for continuously advancing the main frame in an operating direction, a brake means is connected to the single undercarriage for stopping the advancing main frame, and an operator's cab, a control arrangement and a power plant are mounted on the continuously advancing main frame. The machine further comprises a tool-carrying frame, an undercarriage supporting the tool-carrying frame on the track, the tool-carrying frame supporting undercarriage being spaced from the main frame supporting undercarriage a sufficient distance to permit free displacement of the track during leveling and lining and the projecting main frame portion being longitudinally displaceably supported on the tool-carrying frame in said direction, and a drive means for intermittently advancing the tool-carrying frame. Track leveling and lining and tie tamping tool means are mounted on the tool-carrying frame within sight of the operator's cab, the tool means including drives for operating the tool means and the drives being actuated by the control arrangement, and a track position reference system is connected to the control arrangement for actuating the drives of the track leveling and lining tools in response to the track position detected by the reference system.

This arrangement of the main and tool-carrying frames which are longitudinally displaceable with respect to each other and the provision of a single undercarriage for support of the main frame on the track greatly simplifies the structure of the continuously advancing tamper. The support of only one end of the main frame on the track makes it possible to make the same of lighter construction and a further saving is obtained by omitting a second undercarriage for its support. The support of the other end of the main frame on the tool-carrying frame causes the weight of the main frame to press the tool-carrying frame down against the track, which reduces the chances of a possible lifting of the tool-carrying frame off the track, for example when the tamping tools are lowered into a heavily encrusted ballast bed. Since the main frame is longitudinally displaceably supported on the tool-carrying frame in the direction of the track or the longitudinal extension of the machine, a large proportion of the machine mass or weight, including the operator's cab, advances continuously, which reduces the required drive and braking forces, compared to stop-and-go machines. In addition, the operator is not subjected to the constantly alternating acceleration and deceleration forces encountered in stop-and-go machines. Only a relatively small proportion of the machine weight is intermittently accelerated and braked with the tool-carrying frame during the tie tamping cycles. A main frame with a single undercarriage can be of very simple structure and its own drive and brake means assures a dependable continuous advance during the track leveling, lining and tamping operation.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
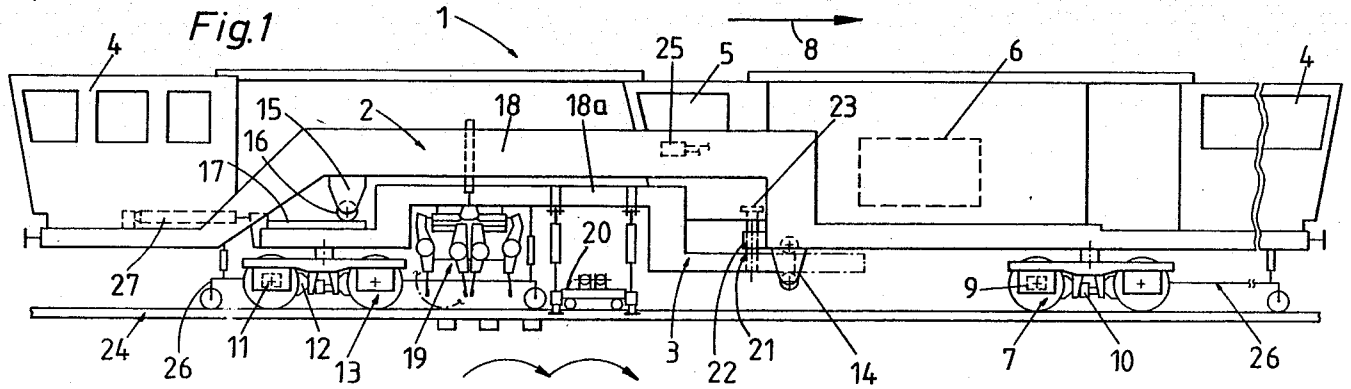
FIG. 1 is a side elevational view of one embodiment of a continuously advancing track leveling, lining and tamping machine of this invention, wherein a portion of the main frame projecting in the direction of the track from its single undercarriage is longitudinally displaceably supported on a portion of the intermittently advancing tool-carrying frame above a single undercarriage supporting the tool-carrying frame on the track.
Figure 2:
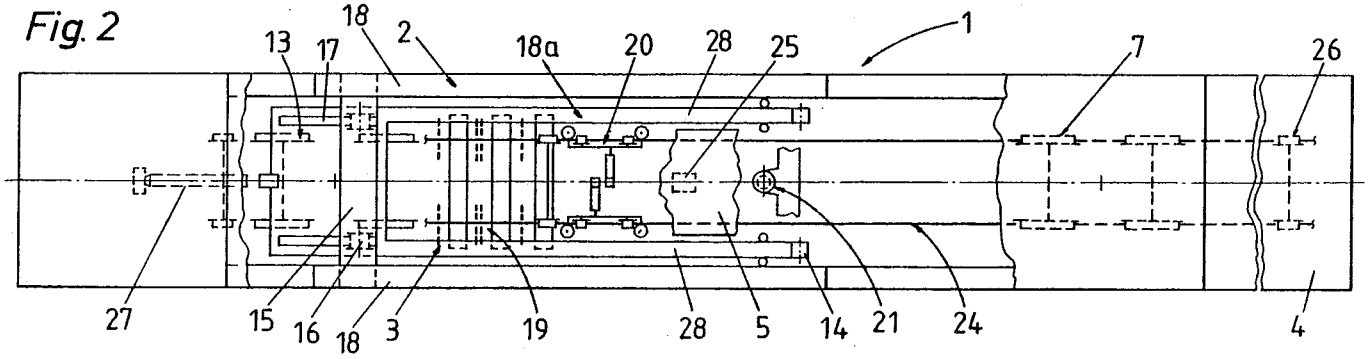
FIG. 2 is a diagrammatic top view of the machine of FIG. 1.

Referring now to the drawing, FIGS. 1 and 2 show continuously advancing machine 1 for leveling, lining and tamping railroad track 24. The illustrated machine comprises main frame 2 extending longitudinally in the direction of the track. Single undercarriage 7 is a swivel truck which supports main frame 2 on track 24 and the main frame has elongated, upwardly recessed portion 18 projecting in this direction from single undercarriage 7. Drive means 9 is connected to swivel truck 7 for continuously advancing main frame 2 in an operating direction indicated by arrow 8 and brake means 10 is connected to the swivel truck for stopping the advancing main frame. Operator's cab 5, control arrangement 25 and power plant 6 are mounted on continuously advancing main frame 2. The machine further comprises tool-carrying frame 3 arranged within the upwardly recessed portion of main frame 2 and single undercarriage 13 supports the tool-carrying frame on track 24. Tool-carrying frame supporting undercarriage 13 also is a swivel truck and is spaced from swivel truck 7 a sufficient distance to permit free displacement of the track during leveling and lining, i.e. the track rails may be suitably flexed or bent when they are lifted or laterally moved during leveling or lining. The projecting main frame portion is longitudinally displaceably supported on tool-carrying frame 3 in the direction of the track. Drive means 11 and brake means 12 are connected to swivel truck 13 for intermittently advancing tool-carrying frame 3. Tie tamping tool means 19 and track leveling and lining tool means 20 are mounted on the tool-carrying frame within sight of operator's cab 5, these tool means being conventional and including drives for operating the tool means and being actuated by control arrangement 25. The machine also comprises a conventional track position reference system 26 connected to the control arrangement for actuating the drives of the track leveling and lining tools in response to the track position detected by the reference system.

In the embodiment of FIGS. 1 and 2, tool-carrying frame 3 has portion **18*a* projecting from undercarriage 13 and roller bearing means 14, 15 are interposed between the main and tool-carrying frames for longitudinally displaceably guiding the frames. A front end of forwardly projecting tool-carrying frame portion 18*a* is longitudinally displaceably and transversely pivotally supported by rollers on two roller bearing guides 14 affixed to main frame portion 18. Roller bearing means 15 comprises two transversely spaced rollers 16 affixed to projecting main frame portion 18 and rotatable about axes extending transversely to the direction of the track, the rollers engaging longitudinal guides 17 mounted on a portion of tool-carrying frame 3 above undercarriage 13. As shown, projecting tool-carrying frame portion 18*a* extends to and below operator's cab 5 on main frame 2 behind main frame supporting undercarriage 7** in the operating direction.

The illustrated frame structures with their elongated portions projecting from a single undercarriage supporting each frame on the track considerably simplifies the construction of the entire machine and permits the two undercarriages to be widely spaced, the wheel base of the machine being long enough even when the two frames are longitudinally displaced towards each other to a maximum extent to permit a continuous vertical and/or lateral track position correction without unduly stressing the rails because of the long flexing or bending lines of the rails. Providing each frame with its own drive and brake means connected to a single undercarriage supporting each frame on the track assures the smooth continuous advance of the main frame without receiving any impacts from the independently, intermittently advancing tool-carrying frame. Supporting the main frame on a portion of the tool-carrying frame above its supporting undercarriage has the advantage of avoiding undue stress on the main frame and, furthermore, subjects the tamped track at this point to an increased load, which is quite desirable for the solidification of the compacted ballast. In addition, with this simple, yet robust, main frame structure which entirely bridges the tool-carrying frame, the tool-carrying frame may carry twin tamping tool assemblies for simultaneously tamping two ties during each cycle.

Immediately adjacent and preceding undercarriage 13, projecting tool-carrying frame portion **18*a* carries vertically adjustable twin tamping tool assembly 19 including drives for reciprocating and vibrating pairs of tamping tools for tamping ballast under ties extending between the pairs of tamping tools. Preceding the tamping tool assembly, tool-carrying frame portion 18a carries vertically and transversely adjustable track lifting and lining unit 20. As shown, the machine also comprises blocking means 21 operable to interconnect intermittently advancing tool-carrying frame 3 and continuously advancing main frame 2 for common advance of the frames so that the tool-carrying frame is locked to the main frame when the machine is moved between operating sites by a driver in a respective driver's cab 4 mounted on main frame 2 at each end thereof. The illustrated blocking means comprises retaining element 22 affixed to the main frame and a plug-in bolt 23 insertable vertically into the retaining element and an aligned bore in the tool-carrying frame. Actuation of all the drives of the tie tamping and track leveling and lining tools is centrally controlled from control panel 25 in operator's cab 5. In addition to the drive and brake means 11, 12 for the intermittent advance of tool-carrying frame 3, hydraulically operated cylinder-piston device 27 links the main and tool-carrying frames. The arcuate arrows indicate the intermittent advance of tool-carrying frame 3 with track leveling and lining tool and tie tamping tool means 19, 20** from tamping station to tamping station.

As can be seen in FIG. 2, projecting tool-carrying frame portion 18a is comprised of two parallel carrier beams 28, 28 extending in the direction of the track, each beam defining a respective bore for plug-in bolt 23. Operator's cab 5 is mounted on main carrier 2 above and between carrier beams 28 to enable the operating tools to be viewed directly by an operator who controls their actuation while frames 2 and 3 are longitudinally displaced relative to each other. The operator's cab is arranged between two driver's cabs 4, 4 mounted at respective ends of the machine.

During operation of track leveling, lining and tamping machine 1 in the operating direction indicated by arrow 8, the operator in cab 5 actuates drive 9 of undercarriage 7 from control panel 25 to advance the main frame continuously along track 24, the power for all the drives being supplied by power plant 6. Simultaneously with the continuous advance of main frame 2, the intermittent advance of tool-carrying frame 3 is effectuated from the control panel by actuating drive 11 and brake 12, the drive being actuated after each tamping cycle has been completed and the tamping tools have been lifted out of the ballast while the brake is actuated when the tamping tools have been centered over a tie or ties to be tamped. Drive 11 rapidly moves tool-carrying frame 3 forwardly from the retracted, rest position shown in full lines to a forward, operating position shown in dash-dotted lines, at which point brake 13 is actuated. In the operating position, the tamping tools are centered over the next tie or ties to be tamped, in which position the tamping tool assembly is lowered to immerse the tamping tools in the ballast and the tamping tools are reciprocated and vibrated to tamp ballast under the tie or ties. When tool-carrying frame 3 is rapidly advanced, rollers 16 will roll along recessed guides 17 to cause a relative displacement between frames 2 and 3, parallel guide grooves 17, 17 providing an exact lateral guide during the longitudinal displacement. Roller bearing means 14 may be transversely adjustable on main frame 2 by remote-controlled adjustment drive means so that track leveling and lining tool and tie tamping tool means 20, 19 may be properly centered over track 24 in track curves.

Figure 3:
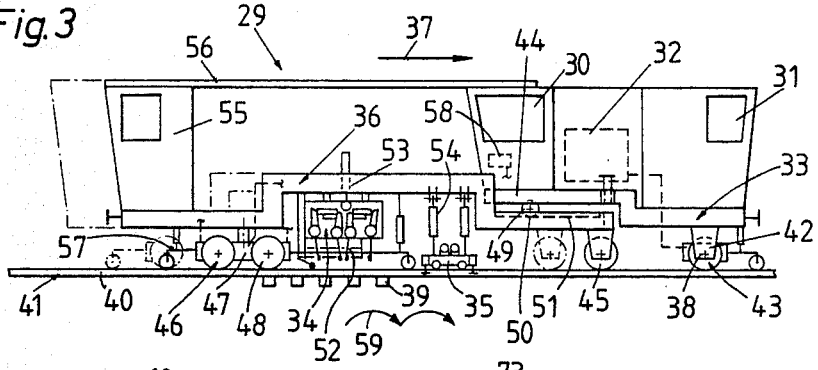
FIG. 3 is a side elevational view showing a further embodiment of the machine, wherein the tool-carrying frame is supported on the track by two undercarriages.

In the embodiment shown in FIG. 3, track leveling, lining and tamping machine 29 comprises a relatively short main frame 33 carrying driver's cab 31 at one end thereof, operator's cab 30 at an opposite end, central power plant 32 supplying power to all the drives of the machines and control arrangement 58 in cab 30. Tool-carrying frame 36 of this machine is elongated and opposite ends thereof are supported by undercarriages 45, 46 on track 41 consisting of rails 40 fastened to ties 39, the undercarriages being widely spaced from each other in the direction of the track. Tool-carrying frame 36 has an upwardly recessed portion between undercarriages 45, 46 and tamping tool assembly 34 and track lifting and lining unit 35 are mounted on frame 36 in this recessed frame portion. The tamping tool assembly is vertically adjustable on the tool-carrying frame by drive 53 and comprises pairs of reciprocable and vibratory tamping tools 52. The track lifting and lining unit is vertically and laterally adjustable on frame 36 by drives 54. The rear end of tool-carrying frame 36 carries driver's cab 55 equipped with a forwardly projecting roof 56 extending over frame 36 to operator's cab 30 on which its free end is slidably supported. The machine furthermore comprises track position reference system 57 for controlling leveling and lining of track 41.

A front portion of main frame 33 in the operating direction indicated by arrow 37 is supported by single undercarriage 38 on track 41 and portion 44 of main frame 33 projects from undercarriage 38 towards tool-carrying frame 36. Drive 42 and brake 43 are connected to undercarriage 38, the drive being supplied with power from plant 32 for continuously advancing the main frame in the operating direction. Projecting main frame portion 44 is longitudinally displaceably supported on tool-carrying frame 36 and single undercarriage 38 supporting main frame 33 on track 41 precedes tool-carrying frame 36 in the operating direction. Drive 47 and brake 48 are connected to rear undercarriage 46 in the operating direction for intermittently advancing the tool-carrying frame. While main frame 33 advances continuously and tool-carrying frame 36 advances intermittently during operation, the two frames are locked together for common movement by blocking means of the same type as shown in FIG. 1 when the machine is moved between operating sites.

This frame construction provides a short, simple and robust main frame structure securely longitudinally displaceably supported by a tool-carrying frame which is supported at both ends on the track, without subjecting the tool-carrying frame to undue bending stresses. The operator's cab mounted at the end of the projecting main frame portion keeps the operating tools always within sight of the operator while the cab advances continuously, and the entire arrangement enables all the operating drives, with their power plant and control arrangement to be arranged most effectively.

The end of projecting main frame portion 44 carrying operator's cab 30 is longitudinally displaceably guided on a portion of tool-carrying frame 36 preceding rear undercarriage 46 in the operating direction, for which purpose roller bearing 49 having roller 50 affixed to the main frame and guided in longitudinally extending guide groove 49 on frame 36 is provided. The operator's cab may be substantially centered on the machine to be within sight of the operating tools, the arrangement of the cab ahead of the operating tools in the operating direction enabling the operator in the cab to view the operation while he sits with his back turned in this direction.

During operation, the operator in cab 30 actuates drive 42 from control panel 58 to advance main frame 33 continuously in the operating direction indicated by arrow 37 while, at the same time, actuating drive 47 to advance tool-carrying frame 36 intermittently, as indicated by arcuate arrows 59, from a rear position indicated in phantom lines to a forward position shown in full lines. After tamping tools 52 have been centered over the two adjacent ties 39 to be tamped, drive 53 is actuated to lower tamping tool assembly 34 and to immerse the tamping tools in the ballast. Upon reciprocation and vibration of the tamping tools, ballast is tamped under the ties. Responsive to track position control signals fed to control arrangement 58 from reference system 57, drives 54 are actuated to level and/or line the track, the spacing between undercarriages 45, 46 being sufficient to permit free displacement of track 41 during the leveling and/or lining operation. While tool-carrying frame 36 stands still during the tamping cycle, the continuously advancing main frame will be longitudinally displaced with respect to the tool-carrying frame, rollers 50 moving to the front end of longitudinal guide 51. This also increases the distance between undercarriages 45 and 38 until the tamping cycle has been completed, tamping tool assembly 34 is lifted, brake 48 is released and drive 47 is actuated again to advance the tool-carrying frame rapidly into its forward end position.

Figure 4:
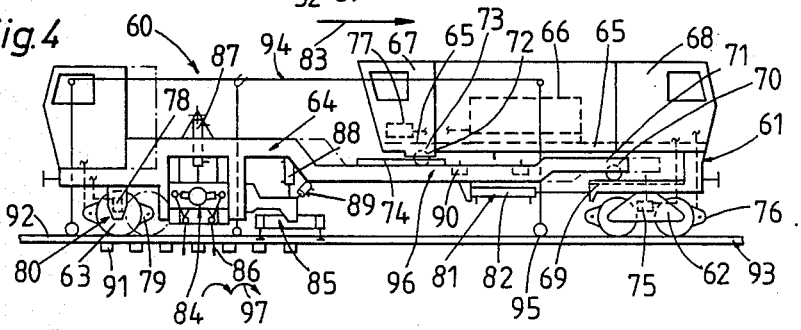
FIG. 4 is a like side elevational view of a third embodiment of the machine, wherein the tool-carrying frame has a portion projecting from its single undercarriage and this tool-carrying frame portion is longitudinally displaceably supported on a portion of the main frame above the single undercarriage supporting the main frame on the track.

Continuously advancing track leveling, lining and tamping machine 60 illustrated in FIG. 4 comprises main frame 61 whose single undercarriage 62 is a swivel truck and tool-carrying frame 64 supported by a single undercarriage 63. Drive 75 and brake 76 are connected to swivel truck 62. Projecting main frame portion 65 carries power plant 66, operator's cab 67 and driver's cab 68 at a forward end of the main frame supported by the swivel truck. Control panel 77 is arranged in operator's cab 67 for control of all the operating drives of machine 60. Main frame 61 is U-shaped and a projecting portion of tool-carrying frame 64 is received between two downwardly extending parallel legs of the U-shaped main frame in longitudinal guide 69 defined in the main frame legs, the longitudinal guide forming roller bearing means 71 with longitudinally displaceably guide rollers 70 affixed to the projecting tool-carrying frame portion. Another roller bearing means 73 supports projecting main frame portion 65 on the projecting tool-carrying portion, its rollers 72 being affixed to the projecting main frame portion and being longitudinally guided in guide 74 defined in the projecting tool-carrying frame portion.

Drive 78 and brake 79 are connected to single undercarriage 63 for intermittently advancing and stopping tool-carrying frame 64, as schematically indicated by short arcuate arrows 97, and hydraulically operated cylinder-piston drive 82 links the main and tool-carrying frames and constitutes blocking means 81 for locking the two frames together for movement in unison when the machine is driven from one to another operating site. As seen in the operating direction indicated by arrow 83, tie tamping tool means 84 is mounted on tool-carrying frame 64 immediate preceding undercarriage 63 and track leveling and lining tool means 85 is mounted on frame 64 preceding the tie tamping tool means. This arrangement provides the technologically required sequence of the operating tools on a self-propelled frame while at the same time assuring the operator in cab 67 clear sight of the operation. The tie tamping tool means is vertically adjustably mounted on the tool-carrying frame by drive 87 and comprises pairs of reciprocable, vibratory tamping tools 86. Vertically and laterally adjustable lifting and lining drives 88, 89 link track leveling and lining unit 85 to tool-carrying frame 64. Drive 78 and brake 79 are automatically controlled by control arrangement 77 in dependence on the operating cycle, particularly the lowering and raising of the tie tamping tool means, by limit switch 70 on tool-carrying frame 64 and a time-delay element cooperating therewith. Leveling and lining errors of track 93 consisting of rails 92 fastened to ties 91 are detected by leveling and lining reference system 94 whose rail position sensing rollers 95 are vertically adjustably mounted on tool-carrying frame 64.

In operation, drive 75 is operated from control panel 77 for continuously advancing main frame 61 in the operating direction indicated by arrow 83 and drive 78 and brake 79 are alternately operated for intermittently advancing tool-carrying frame 64, as shown by arrows 97. Tie tamping tool means 84 is lowered by drive 87 to immerse tamping tools 86 in the ballast and tamp tie 91 after tool-carrying frame 64 has been stopped by brake 79, the continuous advance of main frame 61 causing a relative longitudinal displacement of the main frame relative to the tool-carrying frame, rollers 70 and 72 rolling along longitudinal guides 69 and 74. The two limit switches 90 assure that the longitudinal displacement path of the rollers is limited to the length of the longitudinal guides. Hydraulically operated cylinder-piston drive 82 may be operated to assist the operation of drive 78 and brake 79. This assures a rapid advance of tool-carrying frame 64 into its forward end position shown in phantom lines after each tamping cycle, blocking of further pressure fluid to drive 82 assisting in the rapid braking of the tool-carrying frame by brake 79. Meanwhile, operator's cab 67 smoothly and continuously advances along the track.

Figure 5:
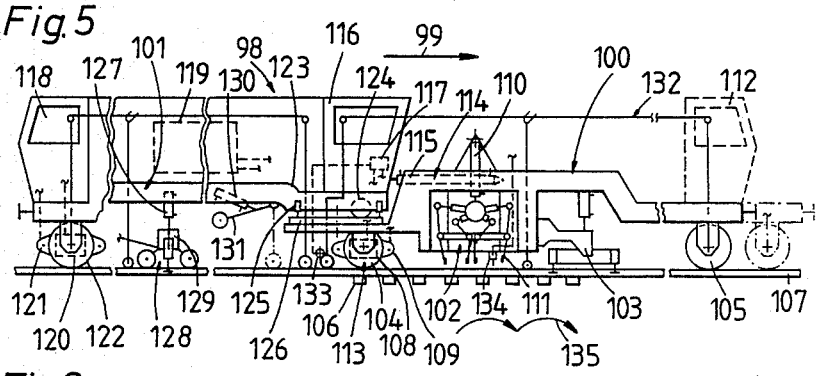
FIG. 5 is a side elevational view of a fourth embodiment of the machine incorporating a track stabilizer mounted on the main frame.

Track leveling, lining and tamping machine 98 shown in FIG. 5 continuously advances in an operating direction indicated by arrow 99 along a track consisting of rails 107 fastened to ties 106. The machine comprises intermittently advancing tool-carrying frame 100 preceding main frame 101 in the operating direction. Two undercarriages 104, 105 support the tool-carrying frame on the track and twin tamping tool assembly 102 and vertically and laterally adjustable track lifting and lining unit 103 are mounted in an upwardly recessed portion of the tool-carrying frame between undercarriages 104, 105. The twin tamping tool assembly is vertically adjustable by drive 110 and comprises closely adjacent pairs of reciprocable, vibratory tamping tools 111 for simultaneously tamping two ties 106 in each tamping cycle. Drive 108 and brake 109 are connected to rear undercarriage 104 of the tool-carrying frame to form means 113 for intermittently advancing the tool-carrying frame. Furthermore, like the embodiment of FIG. 4, the machine is equipped with hydraulically operated cylinder-piston drive 115 which assists the operation of drive and brake means 113 and may also be operated as blocking means 114 during transit of the machine. Driver's cab 112 is shown in phantom lines at the front end of tool-carrying frame 100 for use during transit of the machine between operating sites.

Main frame 101 has a portion 123 projecting forwarding from single undercarriage 122 supporting the main frame on the railroad track and spaced rearwardly from rear undercarriage 104 of the tool-carrying frame. Drive 120 and brake 121 are connected to undercarriage 122 and forwardly projecting main frame portion 123 is longitudinally displaceably supported on tool-carrying frame 100 by roller bearing means 125 comprised of rollers 124 affixed to the main frame and displaceable in longitudinal guide 126 mounted rotatably about a vertical axis on tool-carrying frame 100 above rear undercarriage 104. This arrangement enables the operator in cab 116 to view the tamping, leveling and lining operations advantageously in the operating direction. The preceding track section may be more easily surveyed and controlled at regular intervals. The two widely spaced undercarriages supporting the tool-carrying frame fully support the weight of the operating tools and none of the tool-carrying frame weight is transmitted to the main frame. The main frame carries driver's cab 118 at a rear end thereof above undercarriage 122 and forwardly projecting main frame portion 123 carries power plant 119 and operator's cab 116 with control arrangement 117.

Vertically adjustable track stabilizer 128 including track vibrator 129 is mounted on main frame 101 between undercarriages 122 and 104, drive 127 connecting the track stabilizer to the main frame and pressing the same against the track when vibrator 129 is operated to settle the track held by the stabilizer into the ballast. Leveling and lining reference system 132 controls the track leveling and lining as well as vertical drive 127 of the track stabilizer. This arrangement combines all the advantages of two differently proceeding operating cycles, i.e. intermittent tamping and continuous track stabilization, in a single simple machine and provides, therefore, a particularly economical construction.

A flanged wheel support 131 is pivotally mounted on projecting main frame portion 123 and is pivotal between a retracted position (shown in full lines) and a track engaging position (shown in phantom lines) by drive 130 for supporting the projecting main frame portion like a trailer behind tool-carrying frame 100. This enables the main frame to be rapidly and simply detached from the tool-carrying frame and the tool-carrying frame to be used alone for minor tamping work. On the other hand, the detached main frame may be coupled to a different tool-carrying frame.

Drive 108 and brake 109 are automatically operable by control arrangement 117 in response to the operating cycle of tie tamping and track leveling and lining tool means 102, 103, and the control arrangement comprises odometer 133 measuring the distance of the intermittent advances to determine each operating cycle. In this manner, the intermittent advance of tool-carrying frame 100 may be controlled by an operator in cab 116 or automatically by odometer 133. The odometer transmits a control signal to control arrangement 117 which corresponds to a predetermined unit of the distance of the advance measured by the odometer, and the control arrangement controls the hydraulic fluid flow to drive 115 in response to this control signal, the fluid flow being blocked to hold the tool-carrying frame in a position wherein tamping tools 111 are centered over two adjacent ties 106. After the tie tamping is completed and the twin tamping tool assembly is raised, control arrangement 117 re-starts the hydraulic fluid flow to drive 115 and actuates drives 108 so that the tool-carrying frame is rapidly advanced again to center the tamping tools over the next ties to be tamped. The lowering of the tamping tool assembly re-sets the odometer to its zero position, and a new operating cycle starts. An inductive control signal emitter 134 is mounted on tamping tool assembly 104 in the range of tamping tools 111 to sense the spikes or bolts fastening the rails to the ties, and these control signals are transmitted to control arrangement 117. Inductive control signal emitter 134 enables the tamping tools to be accurately centered with respect to the two adjacent ties being tamped. The use of a twin tamping tool assembly, which tamps two adjacent ties simultaneously during each operating cycle, enables the main frame with track stabilizer 128 to be continuously advanced at a relatively rapid pace.

In operation, drive 108 and/or drive 115 is actuated for the intermittent advance of tool-carrying frame 100, as schematically indicated by arcuate arrows 135, brake 109 and/or blockage of drive 115 is then actuated to stop the advance of the tool-carrying frame in its forward end or operating position, and the tamping tool assembly 102 is lowered to effectuate tamping of ties 106, while track stabilizer 128 settles the tamped ballast bed in a controlled manner. At the same time, drive 120 is actuated for continuously advancing the main frame 101 while the tool-carrying frame is advanced intermittently, causing relative longitudinal displacement between the frames. Since longitudinal guide 126 for rollers 124 is freely rotatable about a vertical axis, the two frames may laterally pivot with respect to each other so that machine 98 may be operated even in sharp curves.

Figure 6:
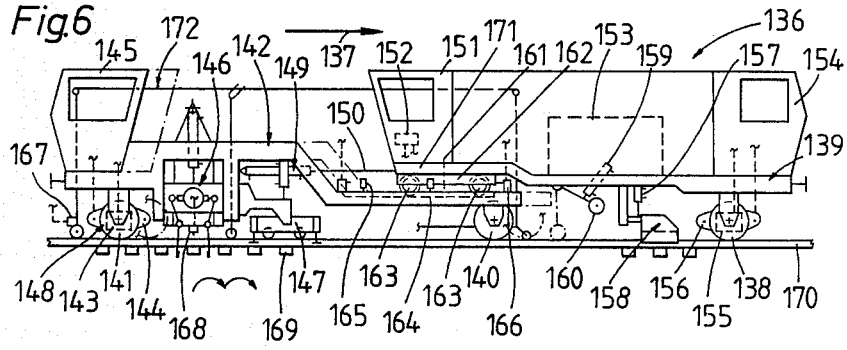
FIG. 6 is a side elevational view of a fifth embodiment of the machine incorporating a ballast plow.

In the embodiment of the invention illustrated in FIG. 6, track leveling, lining and tamping machine 136 continuously advances in an operating direction indicated by arrow 137 along a railroad track consisting of rails 170 fastened to ties 169. The machine comprises main frame 139 supported by single undercarriage 138 and preceding tool-carrying frame 142 in the operating direction, the tool-carrying frame being supported by two undercarriages 140, 141 at respective ends thereof. The two frames are longitudinally displaceable with respect to each other and drive 143 and brake 144 are connected to rear undercarriage 141 to form means 148 for intermittently advancing and stopping the tool-carrying frame, as schematically indicated by short arcuate arrows, while the main frame is continuously advanced by drive 155 connected to single undercarriage 138 of the main frame. Brake 156 is also connected to this single undercarriage. Hydraulically operated cylinder-piston drive 150 links the frames and, as has been explained hereinabove, can be operated to assist in the intermittent advance and stopping of the tool-carrying frame as well as a blocking means 149 for locking the two frames together for common advance. The rear end of tool-carrying frame 142 carries driver's cab 145 for use by a driver of the machine during transit thereof between operating sites. Immediately preceding rear undercarriage 141, vertically adjustable tamping tool assembly 146 with pairs of reciprocable, vibratory tamping tools is mounted in an upwardly recessed portion of the tool-carrying frame 142, and this is preceded by vertically and laterally adjustable track leveling and lining unit 147. Main frame 139 carries operator's cab 151 and control arrangement 152 as well as power plant 153 and driver's cab 154 at the front end of the main frame.

Ballast plow 158 is mounted on the main frame between spaced undercarriages 138, 140 and is vertically adjustable by drive 157. Immediately behind the ballast plow, flanged wheel support 160 is pivotally mounted on projecting main frame portion 171 and is pivotal between a retracted position (shown in full lines) and a track engaging position (shown in phantom lines) by drive 159 for supporting the projecting main frame portion like a trailer in front of tool-carrying frame 142 on which the projecting main frame portion is longitudinally displaceably supported. The ballast plow mounted on the continuously advancing main frame enables ballast to be continuously and evenly distributed for the subsequent tie tamping.

The rear end of projecting main frame portion 171 is supported on a forwardly projecting portion of tool-carrying frame 142 by roller bearing 162 rotatable about vertical axis 141. The roller bearing comprises two flanged rollers 163 spaced from each other in the operating direction and rotatable about transverse axes journaled on the main frame, and longitudinal guides 164 affixed to the tool-carrying frame and engaged by the flanged rollers. Rollers 163 are guided on guides 164 by lateral guide rollers 165 rotatable about vertical axes on the tool-carrying frame. Limit switches 166 at each end of longitudinal guides 164 are connected to control arrangement 152 to delimit the maximum stroke of each relative displacement of the tool-carrying frame with respect to the main frame. As also described hereinabove in connection with FIG. 5, the machine further comprises odometer 167 and inductive control signal emitter 168 connected to the control arrangement, as well as leveling and lining reference system 172.

The operation proceeds in the same manner as described hereinabove in connection with FIG. 5, drive 138 being actuated to advance main frame 139 with lowered ballast plow 158 continuously along the track while tool-carrying frame 142 is advanced intermittently between tamping cycles by alternately actuating brake 144 and drives 143, 150, the relative displacement of the tool-carrying frame being indicated in phantom lines. The turntable arrangement of the roller bearing enables frames 139, 142 to move in curves without danger of derailment. Control arrangement 152 may be programmed to stop hydraulic fluid flow to drives 143 and 150 and actuate brake 144 automatically when the distance of the advance of the tool-carrying frame has reached a path length corresponding to an average crib width or this actuation may be manually effected by an operator in cab 151. If the tamping cycle is unduly long, causing a corresponding extended stoppage of the tool-carrying frame, or if the continuously advance is too fast, the corresponding longitudinal displacement between the main frame and the tool-carrying frame will cause front limit switch 166 to be tripped, whereby the forward speed of the main frame will be reduced and/or the tool-carrying frame will be rapidly advanced. On the other hand, if rear limit switch 166 is tripped by the rear end of the projecting main frame portion, the forward speed of the main frame will be automatically increased.

The front rail sensing rollers of reference system 172 are vertically adjustably mounted on tool-carrying frame 142 and pass through an elongated slot in main frame 139 so that the reference system may move intermittently with the tool-carrying frame while the main frame advances continuously.

What is claimed is:

1. A continuously advancing machine for leveling, lining and tamping a railroad track, which comprises (a) a main frame extending longitudinally in the direction of the track, (b) a single undercarriage supporting the main frame on the track and the main frame having a portion projecting in this direction from the single undercarriage, (c) a drive means connected to the single undercarriage for continuously advancing the main frame in an operating direction, (d) a brake means connected to the single undercarriage for stopping the advancing main frame, (e) an operator's cab, an operating control arrangement and a power plant mounted on the continuously advancing main frame, (f) a tool-carrying frame, (g) an undercarriage supporting the tool-carrying frame on the track, (1) the tool-carrying frame supporting undercarriage being spaced from the main frame supporting undercarriage, and (2) the projecting main frame portion being longitudinally displaceably supported on the tool-carrying frame in said direction, (h) a drive means for intermittently advancing the tool-carrying frame, (i) track leveling and lining and tie tamping tool means mounted on the tool-carrying frame within sight of the operator's cab, the tool means including drives for operating the tool means and the drives being actuated by the control arrangement, and (j) a track leveling and lining reference system connected to the control arrangement for actuating the drives of the track leveling and lining tools in response to the track position detected by the reference system.

2. The continuously advancing track leveling, lining and tamping machine of claim 1, wherein a single undercarriage supports the tool-carrying frame and the tool-carrying frame has a portion projecting from the undercarriage supporting the tool-carrying frame, the single undercarriages being sufficiently spaced from each other in said direction to permit free track displacement during track leveling and lining, the track leveling and lining and tie tamping tool means are mounted on the projecting tool-carrying frame portion, the drive means for intermittently advancing the tool-carrying frame is connected to the single tool-carrying frame supporting undercarriage, and further comprising a brake means connected to the single undercarriage for stopping the advancing tool-carrying frame.

3. The continuously advancing track leveling, lining and tamping machine of claim 2, wherein the projecting tool-carrying frame portion extends to and below the operator's cab on the main frame.

4. The continuously advancing track leveling, lining and tamping machine of claim 3, wherein the projecting tool-carrying frame portion extends to and below the operator's cab on the main frame behind the single main frame supporting undercarriage in the operating direction.

5. The continuously advancing track leveling, lining and tamping machine of claim 2, wherein the projecting main frame portion extends to a portion of the tool-carrying frame supported by the undercarriage, and comprising roller bearing means interposed between the projecting main frame portion and the tool-carrying frame portion supported by the undercarriage.

6. The continuously advancing track leveling, lining and tamping machine of claim 2, wherein the undercarriages supporting the main frame and the tool-carrying frame are swivel trucks.

7. The continuously advancing track leveling, lining and tamping machine of claim 2, wherein the projecting tool-carrying frame portion is longitudinally displaceably guided on a portion of the main frame above the single main frame supporting undercarriage, and an end of the projecting main frame portion carrying the operator's cab is longitudinally displaceably guided on the projecting tool-carrying frame portion between the undercarriages supporting the frames.

8. The continuously advancing track leveling, lining and tamping machine of claim 1, wherein the single main frame supporting undercarriage precedes the track leveling and lining and tie tamping tool means mounted on the tool-carrying frame in the operating direction.

9. The continuously advancing track leveling, lining and tamping machine of claim 1, wherein the single undercarriage supporting the main frame precedes the tool-carrying frame in the operating direction.

10. The continuously advancing track leveling, lining and tamping machine of claim 1, wherein the track leveling and lining and the tie tamping tool means are mounted on the tool-carrying frame below the operator's cab, and the operator's cab is arranged between two driver's cabs mounted at respective ends of the machine.

11. The continuously advancing track leveling, lining and tamping machine of claim 1, further comprising a blocking means operable to interconnect the tool-carrying frame and the main frame for common advance of the frames.

12. The continuously advancing track leveling, lining and tamping machine of claim 11, wherein the blocking means comprises a hydraulically operable cylinder-piston drive linking the frames and operable by the control arrangement selectively to drive the tool-carrying frame and to lock the frames together for common advance.

13. The continuously advancing track leveling, lining and tamping machine of claim 1, wherein the drive means for intermittently advancing the tool-carrying frame and a brake means is connected to the tool-carrying frame supporting undercarriage, the drive and brake means being automatically operable by the control arrangement in response to the operating cycle of the tie tamping and track position correcting tool means.

* * * * *